US007147277B1

(12) United States Patent
Miller

(10) Patent No.: US 7,147,277 B1
(45) Date of Patent: Dec. 12, 2006

(54) FOLDABLE CHAIR

(76) Inventor: Greg Miller, 2305 Delaware Dr., St. Charles, MO (US) 63303

( * ) Notice: Subject to any disclaimer, the term of this patent is extended or adjusted under 35 U.S.C. 154(b) by 0 days.

(21) Appl. No.: 11/266,910

(22) Filed: Nov. 4, 2005

(51) Int. Cl.
*A47C 4/34* (2006.01)

(52) U.S. Cl. ..... 297/19; 297/16.1; 297/59; 297/338; 297/28; 297/284.2

(58) Field of Classification Search ..... 297/16.1, 297/19, 27–29, 59, 284.2, 337, 338
See application file for complete search history.

(56) References Cited

U.S. PATENT DOCUMENTS

| | | | | |
|---|---|---|---|---|
| 534,501 | A | 2/1895 | Evers | |
| 1,694,933 | A * | 12/1928 | Walker et al. | 297/18 |
| 1,876,479 | A * | 9/1932 | Weller | 297/19 |
| 1,963,708 | A | 6/1934 | Marvin | |
| 2,450,783 | A | 10/1948 | Collins | |
| 2,505,702 | A * | 4/1950 | Benjamin | 297/28 |
| 2,732,006 | A * | 1/1956 | Crescent | 297/320 |
| 4,030,781 | A | 6/1977 | Howard | |
| 4,251,107 | A | 2/1981 | Sato | |
| 4,367,894 | A | 1/1983 | Manuel | |
| 5,078,451 | A | 1/1992 | Sobel | |
| 5,087,095 | A | 2/1992 | McFate | |
| 5,110,184 | A | 5/1992 | Stein | |
| 5,244,249 | A * | 9/1993 | Tseng | 297/58 |
| D361,683 | S | 8/1995 | Juhl | |
| 5,464,268 | A * | 11/1995 | Levrangi | 297/57 |
| 5,503,456 | A | 4/1996 | Rossini | |
| 5,588,695 | A | 12/1996 | Gomes | |
| 5,588,696 | A * | 12/1996 | Jay et al. | 297/129 |
| 5,718,473 | A | 2/1998 | Lynch, Jr. | |
| 5,944,384 | A | 8/1999 | Patterson | |
| 5,988,750 | A | 11/1999 | Rubottom | |
| 6,056,172 | A | 5/2000 | Welsh | |
| 6,089,651 | A | 7/2000 | Carmen | |
| 6,382,727 | B1 | 5/2002 | Pickard | |
| 6,471,288 | B1 * | 10/2002 | Alexander, Jr. | 297/56 |
| 6,547,324 | B1 | 4/2003 | Ammann, Jr. | |
| 6,796,605 | B1 | 9/2004 | Chu | |
| 6,926,355 | B1 | 8/2005 | Le Gette et al. | |
| 2002/0145316 | A1 | 10/2002 | Oliver | |
| 2004/0130190 | A1 | 7/2004 | Zheng | |
| 2004/0195879 | A1 | 10/2004 | Amirault | |

FOREIGN PATENT DOCUMENTS

| | | |
|---|---|---|
| EP | 0569317 | 11/1993 |
| JP | 2000135144 | 5/2000 |
| WO | WO2002069757 | 9/2002 |

OTHER PUBLICATIONS

Website: http://www.campmor.com/webapp/wcs/stores/servlet/ProductDisplay, Online store: Campmor.com Product Name: GCI Outdoor The EveRest™ Chair.

* cited by examiner

*Primary Examiner*—Peter R. Brown
(74) *Attorney, Agent, or Firm*—Polster, Lieder, Woodruff & Lucchesi L.C.

(57) ABSTRACT

A chair. The chair folds by a plurality of hinges between an expanded position and a collapsed position to seat a person substantially horizontal while the chair is positioned on an angled surface. The chair comprises a back assembly, a seat assembly, a leg assembly, a seat, an arm assembly, and a foot assembly. The chair further comprises at least one anchor that is configured to penetrate the angled surface in order to stabilize the chair on the angled surface.

20 Claims, 5 Drawing Sheets

FOLDABLE CHAIR

CROSS-REFERENCE TO RELATED APPLICATIONS

Not Applicable.

STATEMENT REGARDING FEDERALLY SPONSORED RESEARCH

Not Applicable.

BACKGROUND OF THE DISCLOSURE

The present disclosure relates to a folding chair, and in particular, a folding chair that anchors to an angled surface while providing a horizontal seat position for the user.

Many parks, common areas and outdoor entertainment venues have ground seating areas that cover hills or inclines. Typically these seating areas do not employ any fixed seats or chairs. Instead, the user sits directly on the seating areas. To eliminate direct contact between the ground of the seating area and the user's bottom, the user typically positions a blanket or folding chair on the ground for sitting purposes. The blanket and folding chair, however, lie on the seating area at the same angle of the ground of the seating area. Therefore, due to the angled ground surface, the user sits at the angle resulting in uncomfortable viewing by the user.

Although current folding chairs have adjustable back rests and adjustable arm rests, the legs of these chairs extend to contact the ground, wherein this configuration positions the seat of the chair at the angle of the ground sitting area. As such, the adjustable back rest and adjustable arm rest do not horizontally position the user with respect to the angled ground.

Other folding chairs employ collapsible fabric as the seat area. This collapsible fabric conforms to the user's bottom when the user sits within the fabric. Due to the leg configurations of these chairs, the user still sits at the angle of the ground sitting area. Furthermore, due to the angled ground, current folding chairs slip on the angled surface since the legs do not anchor to the ground surface.

BRIEF SUMMARY OF THE DISCLOSURE

Briefly stated, the present disclosure relates to a chair that folds by a plurality of hinges between an expanded position and a collapsed position to seat a person substantially horizontal while the chair is positioned on an angled surface. The foldable chair comprises a back assembly having a back frame and a back covering which partially covers the back frame. The back frame includes opposing back side members, wherein each back side member has a first back end and a second back end.

The chair also comprises a seat assembly secured to a seat hinge of the plurality of hinges. The seat hinge pivotally couples the seat assembly to the back assembly. The seat assembly has a seat frame and a seat adjustment assembly, the seat frame includes opposing seat side members, wherein each seat side member has a first seat end and a second seat end. The seat adjustment assembly includes a seat pin and includes a seat track that is integrally disposed within the back side members, wherein the seat track has a plurality of seat adjustment positions.

The chair also comprises a leg assembly secured to a leg hinge of the plurality of hinges. The leg hinge pivotally couples the leg assembly to the seat assembly. The leg assembly has a leg frame, which includes opposing leg side members, wherein each leg side member has a first leg end and a second leg end.

The chair also comprises an arm assembly removably attached to the seat side members and removably attached to the back side members. The arm assembly is adjustable to a substantially horizontal position while the chair is positioned on the angled surface. The arm assembly has a first arm track and a second arm track, wherein each arm track has a plurality of arm adjustment positions.

The chair further comprises a collapsible seat that is removably coupled to the seat assembly. The collapsible seat has a proximal end, a distal end and a body positioned between the proximal end and the distal end. The proximal end connects with adjustment pin disposed and the distal end connects with a seat attachment wherein the adjustment pin removably engages with at least one of the plurality of seat adjustment positions of the seat track and the seat attachment connects with the seat pin such that the engaged adjustment pin with the seat track and the attached distal end with the seat pin positions the body of the seat in a substantially horizontal position with respect to the angled surface.

The foregoing and other objects, features, and advantages of the disclosure as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure.

Figure 1:
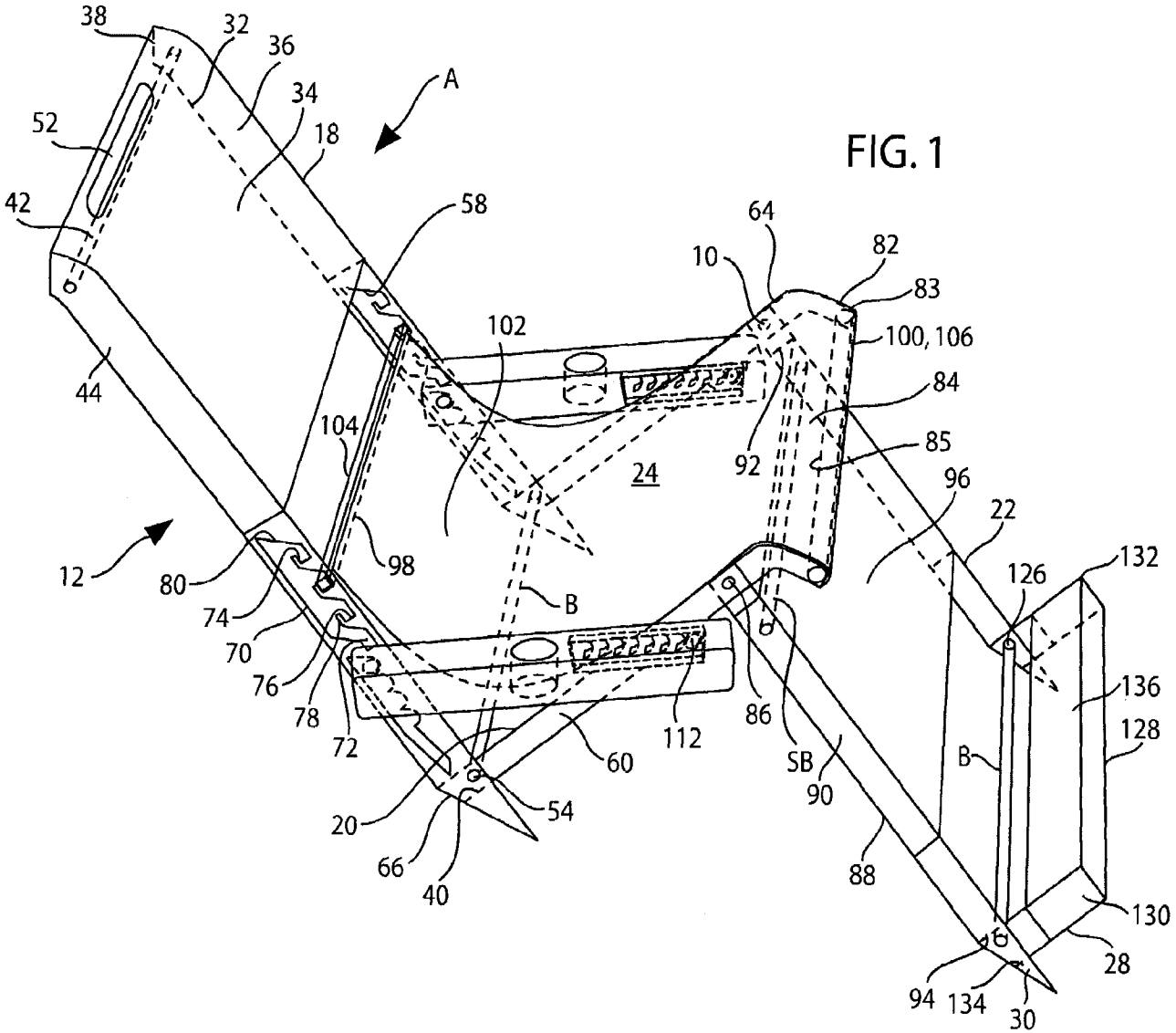
FIG. 1 is an isometric view of a foldable chair illustrating a back assembly, an arm assembly, a seat assembly, a leg assembly and a foot assembly constructed in accordance with and embodying the present disclosure.
Figure 3:
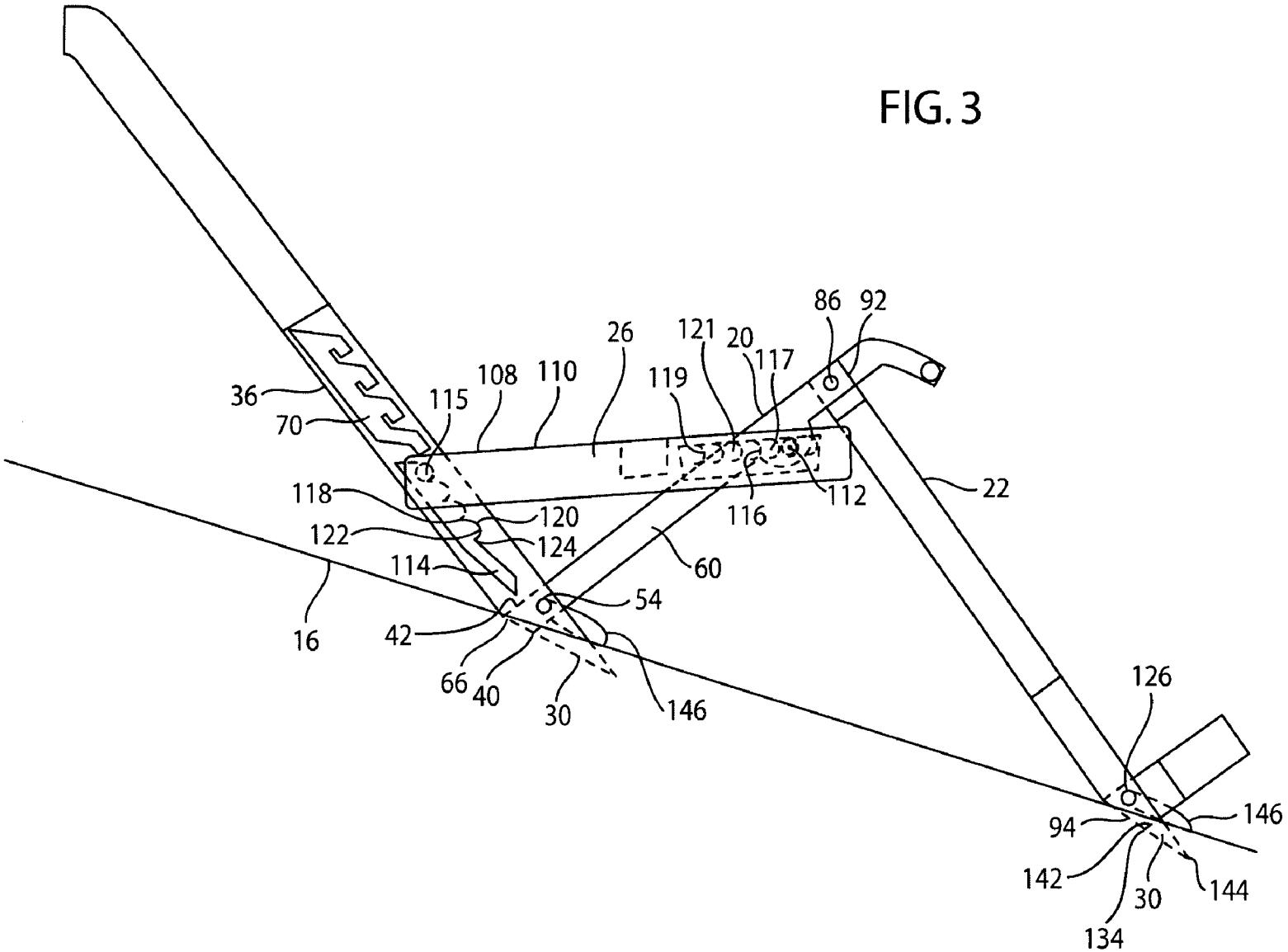
FIG. 3 is a side elevational view of the foldable chair of FIG. 1 illustrating the foldable chair positioned in an expanded position on an angled surface such that the seat is positioned substantially horizontal with respect to the angled surface.

Referring to the drawings, a chair A (FIG. 1) folds by a plurality of hinges 10 between an expanded position 12 and a collapsed position 14 (FIG. 4) to seat a person substantially horizontal while the chair A is positioned in the expanded position 12 on an angled surface 16 (FIG. 3). As will be discussed, hinges 10 relate to the seat hinges 54, leg hinges 86 and foot hinges 126. For illustrative purposes, one hinge 10 is shown in FIG. 1. The hinges 10 comprise moveable joints which pivot or rotate around a connecting member such as a pin. The chair A comprises a back assembly 18, a seat assembly 20, a leg assembly 22, a seat 24, an arm assembly 26 (FIG. 3) and a foot assembly 28. The chair A further comprises at least one anchor 30 which is configured to penetrate the angled surface 16 in order to stabilize the chair A on the angled surface 16. The back assembly 18, seat assembly 20, leg assembly 22, foot assembly 28 and the arm assembly 26 comprise a light weight material including, but not limited to, a metal alloy or plastic. Suitable metal alloys include but are not limited to aluminum, aluminum alloy, steel and steel alloy. The back assembly 18, seat assembly 20, leg assembly 22, foot assembly 28 and arm assembly 26 may comprise channel members, tubular members or straight members.

Referring to FIG. 1, the back assembly 18 has a back frame 32 and a back covering 34 that partially covers the back frame 32. The back frame 32 includes opposing back side members 36 wherein each back side member has a first back end 38 and a second back end 40. Each first back end 38 includes a curved surface to support the back covering 34 while each second back end 40 contacts the angled surface 16 (FIG. 3). In one embodiment, the back side members 36 are approximately 24" in length and approximately 2" in height. The back frame 32 further comprises a back cross member 42 which connects the opposing back side members 36 near the respective first back ends 38.

The back covering 34 comprises a back fabric panel 44 (FIG. 6), which has a front face 46, a back face 48 and side faces 50. The back covering 34 partially covers the back frame 32 wherein the back fabric panel 44 comprises any suitable material such as nylon or canvas. The front and back faces 46, 48 further include a handle aperture 52 defined therethrough. As shown in FIG. 1, the back fabric panel 44 covers the back cross member 42, the first back ends 38 and portions of the back side members 36. The back fabric panel 44 may include reinforcement strips of material to provide a resistant back support for the user.

Seat hinges 54 of the plurality of hinges 10 secures the seat assembly 20 to the back frame 32. In particular, the seat hinges 54 pivotally couple the seat assembly 20 to the second back ends 40 of the back side members 36. In one embodiment, each seat hinge 54 includes joints (not shown) that may be secured at a plurality of angular positions with respect to the ground surface. The seat assembly 20 includes opposing seat side members 60. Each seat side member 60 has a first seat end 64 and a second seat end 66, wherein each of the second seats ends 66 contacts the angled surface 16. Furthermore, the seat assembly 20 includes a crossbar B which connects the seat side members 60 at the opposing seat hinges 54. In one embodiment, the seat side members 60 are approximately 20" in length and approximately 2" in height.

The seat adjustment assembly 58 includes a seat track 70 that is integrally disposed within the back side members 36. The seat track 70 of one of the back side members 36 contains a mirror configuration of the seat track 70 for the other respective back side member 36. Since the seat track 70 is integrally disposed within the back side members 36, the seat track 70 does not extend beyond the back frame 32. The seat track 70 has a plurality of seat adjustment positions 72.

Each seat adjustment position 72 includes a slot 74 having a channel member 76 and a support member 78 which perpendicularly extends above each channel member 76. Each channel member 76 is configured in a rectangular shape. As shown, the plurality of seat adjustment positions 72 is positioned on top of each other while being equally spaced from each other. Furthermore, angled portions 80 of the seat track 70 connect one respective channel member 76 with the next channel member 76.

Figure 6:
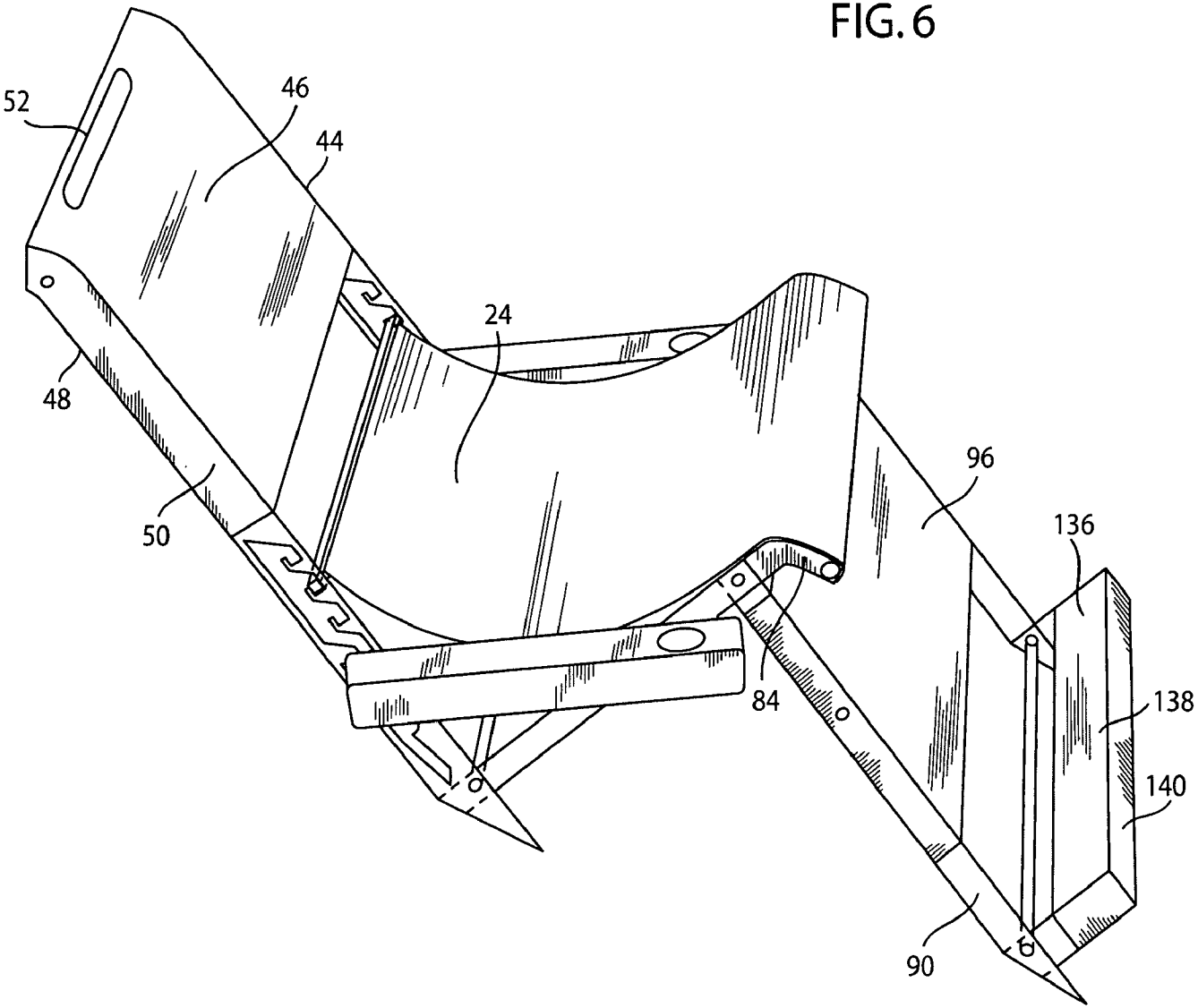
FIG. 6 is an isometric view of the foldable chair of FIG. 1 illustrating a back covering, a seat, a leg covering and a foot covering constructed in accordance with and embodying the present disclosure.

The seat assembly 20 further includes a knee portion 82. The knee portion 82 comprises angled side members 83 which are covered by a knee fabric panel 84 (FIGS. 1 and 6). Additionally, a knee pin 85 connects the opposing angled side members 83. The angled side members 83 and knee fabric panel 84 are configured to outwardly extend (i.e. concavely) from the seat side member 60 to support the user's knees when the user sits within the seat 24.

Leg hinges 86 of the plurality of hinges 10 secures the leg assembly 22 to the seat assembly 20. In particular, each leg hinge 86 pivotally couples the leg assembly 22 to the first seat ends 64 of the seat assembly 20. In one embodiment, each leg hinge 86 includes joints (not shown) that may be secured at a plurality of angular positions with respect to the ground surface. The leg assembly 22 has a leg frame 88 which includes opposing leg side members 90. Each leg side member has a first leg end 92 and a second leg end 94. In one embodiment, leg side members 90 are approximately 18" in length and approximately 1½" in height. Further, the leg frame 88 includes a stabilizing bar SB which connects the opposing leg side members 90. The leg assembly 22 also comprises a leg covering 96 (FIG. 6) which partially covers the leg frame 88. The leg covering 96 extends across to contact the opposing leg side members 90. The leg covering 96 may comprise any suitable material such as a nylon or canvas material.

The collapsible seat 24 removably connects to the seat assembly 20. The collapsible seat has a proximal end 98, a distal end 100 and a body 102 positioned between the proximal end 98 and the distal end 100. The proximal end 98 is positioned near the back assembly 18 while the distal end 100 is positioned near the leg assembly 22. The body 102 of the seat 24 comprises a body fabric panel which may include any suitable material such as a nylon or canvas material. The proximal end 98 connects with or integrates with an adjustment pin 104 while the distal end 100 connects with or integrates with a seat attachment 106. The adjustment pin 104 removably engages with at least one of the plurality of seat adjustment positions 72 of the seat track 70. The seat attachment 106 connects with the knee pin 85 of the knee portion 82 such that the engaged adjustment pin 104 with the seat track 70 and the attached distal end 100 with the knee pin 85 positions the body 102 of the seat 24 in a substantially horizontal position with respect to the angled surface 16. As such, the body 102 of the seat 24 suspends between the seat track 70 at the proximal end 98 and the knee pin at the distal end 100.

As shown in FIG. 1, the seat attachment 106 connects with the knee pin 85 to position the distal end 100 of the seat 24 at the lower ends of the angled side members 83 of the knee portion 82. The seat attachment 106 may be integrally formed with the knee pin 85. For example, the seat attachment 106 may comprise stitching or riveting which connects the distal end 100 of the seat 24 to the knee pin 85. Alternatively, the seat attachment 106 may connect to the knee pin 85 by a removable fastener such as a hook and loop fastener, i.e., Velcro.

The adjustment pin 104 comprises a square or rectangular bar member (FIG. 2), wherein the proximal end 98 of the seat 24 crimps inside the adjustment pin 104. In this configuration, the adjustment pin 104 can be rolled in two directions to shorten the seat 24 or to extend the seat 24. This allows the user to control the tension of the body 102 for a multitude of different seat positions. In one embodiment, the proximal end 98 connects to a bar (not shown) positioned within the adjustment pin 104. The adjustment pin 104 is further sized and shaped to match the channel member 76 of the seat track 70. As such, the proximal end 98 of the seat 24 is spaced from the ends of the adjustment pin 104 such that when the adjustment pin 104 is positioned in any one of the channel members 76 of the seat track 70, the distal end 100 and body 102 of the seat 24 are free to pass between the opposing back side members 36. As such, the seat 24 does not contact the back side members 36.

Since the channel members 76 of the seat track 70 are positioned within the back side members 36, the adjustment pin 104 is also positioned behind the front face 46 of the back covering 34 when the adjustment pin 104 is placed in any of the channel members 76 of the seat track. As such, the user does not directly contact the adjustment pin 104 when seated within the body 102 of the seat 24. Since the proximal end 98 of the seat 24 is crimped within the adjustment pin 104 and the adjustment pin 104 may engage with any of the plurality of seat adjustment positions 72, the user can conveniently suspend the body 102 of the seat 24 between the proximal end 98 and distal end 100.

Turning to FIG. 3, the arm assembly 26 has a first arm 108, a second arm 110, arm connection pins 112, a first arm track 114 and a second arm track 116. Each arm 108, 110 has an engagement pin 115 positioned at the proximal end, i.e., near the back assembly 18. At least one of the arms 108, 110 includes at least one of a cup holder or beverage holder. The cup/beverage holder may be positioned at a plurality of locations along the arms 108, 110. For illustrative purposes, FIGS. 1 and 3 illustrate the cup/beverage holder near the middle of each arm 108, 110 while FIG. 6 illustrates the cup/beverage holder near the end of each arm 108, 110. The arm track 114 is integrally formed within the back side members 36 at a position below the seat track 70 of the seat adjustment assembly 58 (FIG. 1). The arm track 114 of one of the back side members 36 contains a mirror configuration of the arm track 114 for the other respective back side member 36. Since the arm track 114 is integrally disposed within the back side members 36, the arm track 114 does not extend beyond the back frame 32. The arm track 114 has a plurality of arm adjustment positions 118.

Each arm adjustment position 118 includes a slot 120 having a channel member 122 and a support member 124 that perpendicularly extends above each channel member 122. Each channel member 122 is configured in a circular shape. As shown, the plurality of arm adjustment positions 118 is positioned on top of each other while being equally spaced from each other. Furthermore, angled portions of the arm track 114 connect one respective channel member 122 with the next channel member 122.

The arm track 116 is integrally formed within the arms 108, 110 at a position near the first seat ends 64. The arm track 116 of one of the arms 108, 110 contains a mirror configuration of the arm track 116 for the other respective arm 108, 110. The arm track 116 has a plurality of arm adjustment positions 117.

Each arm adjustment position 117 includes a slot 119 having a channel member 121. Each channel member 121 is configured in a circular shape. As shown, the plurality of arm adjustment positions 117 is positioned adjacent to each other while being equally spaced from each other.

The engagement pins 115 of the first arm 108 and the second arm 110 removably engage with at least one of the plurality of arm adjustment positions of the arm track 114. The first arm 108 and the second arm 110 also removably engage with the arm connection pins 112 via the channel members 121 of the second arm track 116. The connection of the engagement pins 115 of first arm 108 and the second arm 110 with one of the arm adjustment positions 118 along with the engagement of the channel members 121 and connections pins 112 of the second arm track 116 positions the first arm 108 and the second arm 110 in a substantially horizontal position with respect to the angled surface 16. As such, the respective arms 108, 110 positions the cup/beverage holder horizontally also. The channel members 121 releasably lock to the arm connection pins 112 when the channel members 121 engage the arm connection pins 112. Since the connection pins 112 extend outward from the seat side members 60, the engagement pins 115 connect the arms 108, 110 to the outside surfaces of the back side members 36.

Returning to FIG. 1, foot hinges 126 of the plurality of hinges 10 secures the foot assembly 28 to the leg assembly 22. In particular, each foot hinge 126 pivotally couples the foot assembly 28 to the second leg ends 94 of the leg frame 88. In one embodiment, the foot hinge 126 includes joints (not shown) that may be secured at a plurality of angular positions with respect to the ground surface. Furthermore, the leg assembly 22 includes a crossbar B that connects the foot side members 130 at the opposing foot hinges 126. The foot assembly 28 has a foot frame 128 which includes opposing foot side members 130 wherein each foot side member has a first foot end 132 and a second foot end 134. In one embodiment, the foot side members 130 are approximately 8" in length and approximately 1½" in height. The foot assembly 28 further comprises a foot fabric panel 136 which contacts each foot side member 130 and extends between each foot side member 130. The foot fabric panel 136 (FIG. 6) may comprise any suitable material such as a nylon or canvas material. The foot fabric panel 136 has a first fabric portion 138 (FIG. 6) and a second fabric portion 140 (FIG. 6) wherein the first fabric portion 138 and the second fabric portion 140 are positioned perpendicular with respect to each other while being positioned between the foot side members 130.

As shown in FIG. 3, the anchors 30 removably attach to both second back ends 40 and both second leg ends 94. Each anchor has a flat end 142 which connects with the respective second end and has a pointed opposite end 144 in order to penetrate the angled surface 16. The anchors 30 may also removably attach to both of the second seat ends 66 (not shown) and the second foot ends 134 (not shown). In one embodiment, the anchor 30 may be fixed to either of the respective second back ends 40, second seat ends 66, second leg ends 94 and the second foot ends 134. Furthermore, stops 146 pivotally couple to the foot hinge 126 and the seat hinge 54. The stops 146 rotatably connect to hinges 54, 126 by a connection means, such as a pin. The hinge stops 146 rotate, via the foot hinge 126 and the seat hinge 54, to contact the angled surface 16 to provide more stabilizing support. As such, the stops 146 rotate to an angle from the respective hinges 54, 126 to match the angled surface 16 to further support the chair A on the angled surface 16.

Furthermore, as shown in FIG. 3 each of the second back ends 40, second seat ends 66, second leg ends 94 and second foot ends 134 contact the angled surface 16. The seat assembly 20 is rotatable around the seat hinge 54 at a plurality of angles with respect to the angled surface 16. Furthermore, the leg assembly 22 is rotatable around the leg hinge 86 at a plurality of leg angles with respect to the angled surface 16. The back assembly 18 is also rotatable around the seat hinge 54 at a plurality of angles with respect to the angled surface 16. The foot assembly 28 is rotatable around the foot hinge 126 at a plurality of angles with respect to the angled surface 16. Since the seat assembly 20, leg assembly 22, back assembly 18 are rotatable at the plurality of angles with respect to the angled surface 16, the chair A may be rotatably positioned on the angled surface 16 in order to position the body 102 of the seat 24 and the arms 108, 110 in a substantially horizontal position with respect to the angled surface 16.

Figure 4:
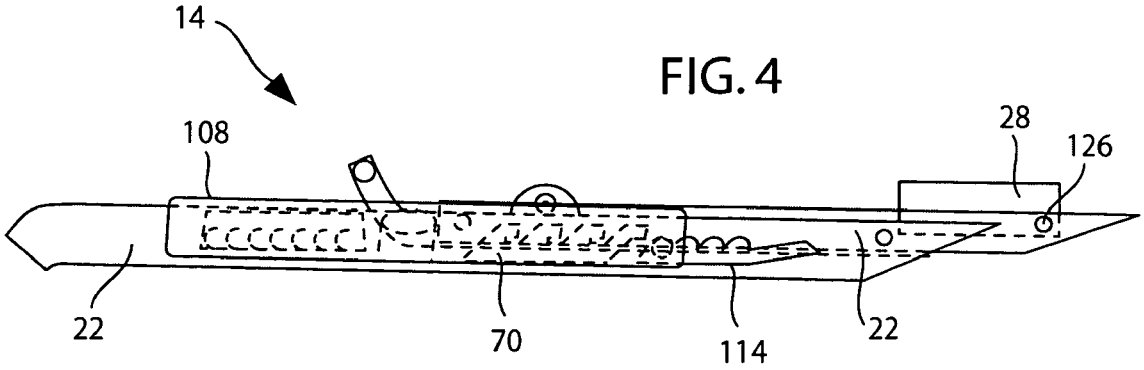
FIG. 4 is a side elevational view of the foldable chair of FIG. 1 illustrating the back assembly, the arm assembly, the seat assembly, the leg assembly and the foot assembly aligned and folded in a collapsed position.
Figure 2:
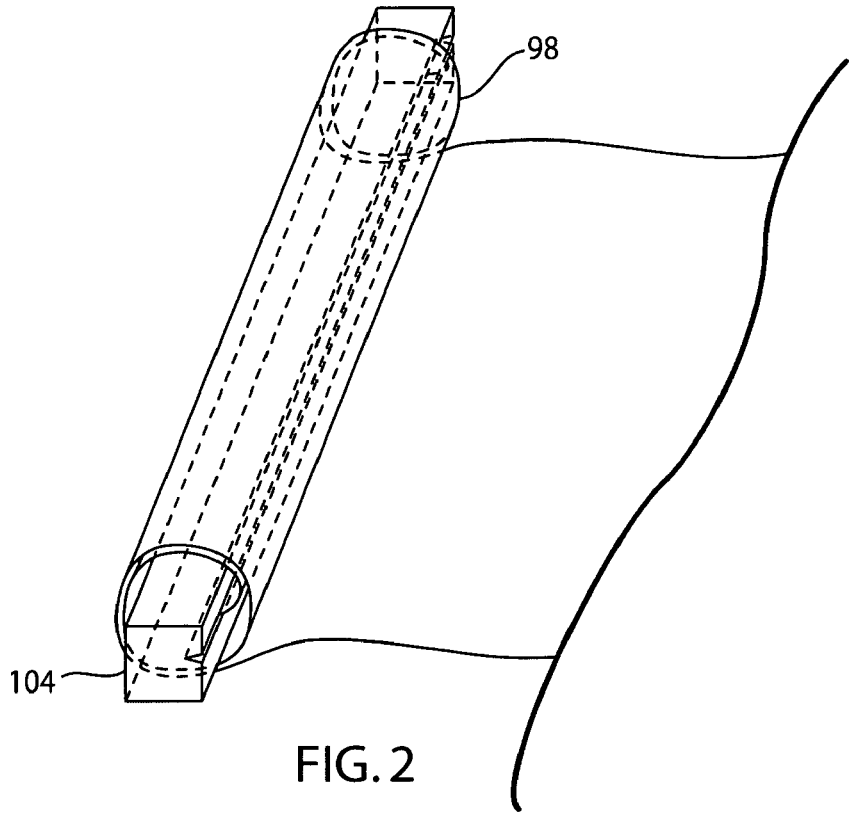
FIG. 2 is a perspective view of an adjustment pin and a portion of a seat constructed in accordance with and embodying the present disclosure.

Turning to FIG. 4 and referring to FIGS. 1–3, the chair A is configured to fold between the collapsed position 14 and the expanded position 12. In the collapsed position 14, the foot assembly 28 folds along the foot hinge 126 toward the leg assembly 22 such that the foot side members 130 fold inside the leg side members 90 of the leg assembly 22. Since the foot assembly 28 is rotatable around the foot hinge 126, at a plurality of angles, the first foot ends 132 rotate upward and toward the first leg ends 92. Since the foot side members 130 are shorter in size than the leg side members 90, the foot assembly 28 easily fits within the seat assembly 20. Once the foot assembly 28 has rotated into the leg assembly 22, the leg assembly 22 rotates around the leg hinge 86 and folds inside the seat assembly 20. Since the leg assembly 22 is rotatable around the leg hinge 86 at a plurality of angles, the second leg ends 94 rotate upward and toward the second seat ends 66 in order to fold within the seat side members 60. Since the leg side members 90 are smaller in size than the seat side members 60, the leg assembly 22 easily fits within the seat assembly 20.

Additionally, the seat assembly 20 rotates within the back assembly 18. Since the seat assembly 20 rotates around the seat hinge 54 at the plurality of angles, the first seat ends 64 rotate toward the first back ends 38 of the back frame 32. Since the seat side members 60 are shorter in length than the back side members 36, the seat assembly 20 easily fits within the back assembly 18. As such, the foot assembly 28, leg assembly 22, seat assembly 20 and back assembly 18 are aligned and folded to provide a convenient and collapsible carrying position for the user. Furthermore, the back side members 36 are longer than the seat side members 60 to extend the handle aperture 52 of the back covering 34 beyond the folded foot assembly 28, leg assembly 22, and seat assembly 20 to provide a convenient access for the user to carry the chair A in the collapsed position 14.

Figure 5A:
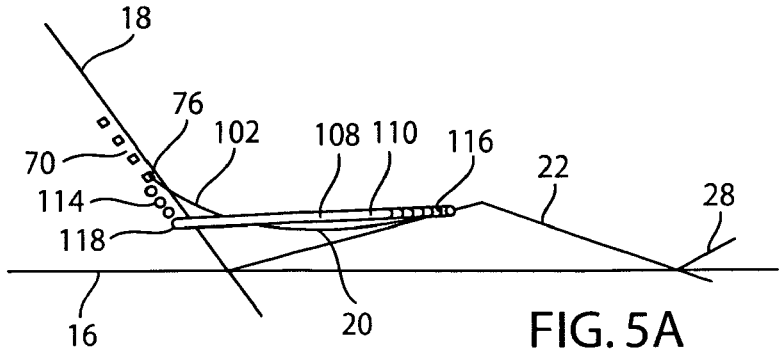
FIGS. 5A–5C illustrate schematic views of the foldable chair of FIG. 1 illustrating the chair positioned on a plurality of angled surfaces wherein the seat is positioned substantially horizontal with respect to each angled surface.
Figure 5B:
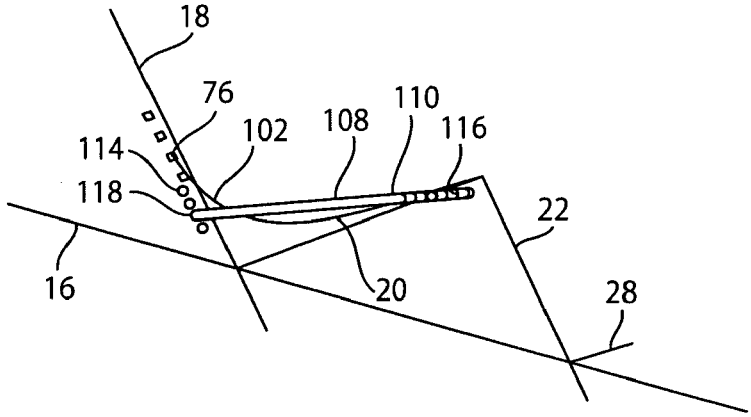
Figure 5C:
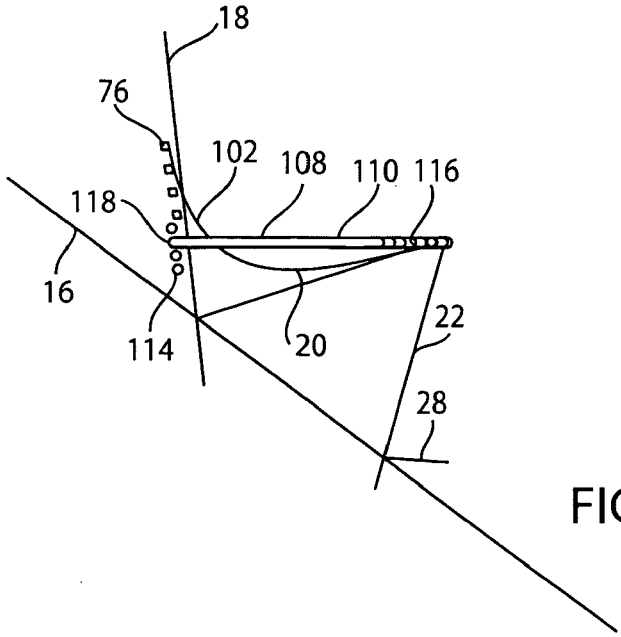

Turning to FIGS. 5A–5C and referring to FIGS. 1–4, during use, the person unfolds the chair A from the collapsed position 14 to the expanded position 12 and positions the chair A on the surface, which may be angled with respect to the horizon. The user conveniently carries the chair A via the handle aperture 52 and places the chair on the angled surface 16 in the collapsed position 14. The user then unfolds the seat assembly 20 from the back assembly 18 by moving the seat assembly 20 along the seat hinge 54. The user anchors the back assembly 18 into the angled surface 16, i.e., the ground by stepping on either of the crossbars B in order to drive the anchors 30 into the angled surface 16. The user levels the first arm 108 and second arm 110 and locks the first arm 108 and the second arm 110 with the first arm track 114 and the second arm track 116.

While unfolding the seat assembly 20, the user engages the adjustment pin 104 of the collapsible seat 24 with at least one of the plurality of seat adjustment positions 72 of the seat track 70. The user, meanwhile, engages the engagement pins 115 of the first arm 108 and the second arm 110 with a one of the plurality of arm positions 118 of the first arm track 114 and engages the connection pins 112 with one of the plurality of arm positions 117 of the second seat track 116. The arms 108, 110 are strong enough to connect and to support the back assembly 18 and the seat assembly 20. In other words, the arms 108, 110 lock the frames of the back assembly 18 and seat assembly 20 into place. Additionally, the user can rotate the adjustment pin 104 to obtain the desired tension of the seat 24. In positioning the adjustment pin 104 in the desired seat adjustment position, the user can position the body 102 of the seat substantially horizontal in the extended position while the chair A is positioned on the angled surface 16.

The user then rotates the leg assembly 22 from inside the seat assembly 20 by rotating the leg assembly 22 around the leg hinge. The user then unfolds the foot assembly 28 via the foot hinge 126 from inside the leg assembly 22 to a desired angled position and locks the foot assembly 28 in that desired position via the foot hinge 126. In rotating the leg hinge 86 in the plurality of angles, the user moves the second leg ends in contact with the angled surface 16. In moving the seat assembly 20 through the plurality of angles via the seat hinge 54, the second seat ends 66 contact the angled surface 16. Depending upon the angle of the surface, the user can easily adjust the angle of the foot assembly 28, leg assembly 22, seat assembly 20 and back assembly 18 through the respective hinges to accommodate the desired position of the foot assembly 28, leg assembly 22, seat assembly 20 and back assembly 18.

Turning to FIG. 5A, on a substantially flat surface, the user positions the adjustment pin 104 in the lower most channel member 76 of the seat track 70 to provide the substantially horizontal position. As the surface angles, however, the user conveniently moves the adjustment pin 104 to the appropriate channel member 76 of the seat track 70 to maintain the body 102 of the collapsible seat in the substantially horizontal position. The user also conveniently moves the engagement pins 115 along the slot 120 to the opposite channel 122 and moves the connection pins 112 along the slot 119 to the appropriate channel 121 to maintain the arms 108, 110 in the substantially horizontal position. For example, in FIG. 5B, the surface angles at approximately 45 degrees. The user conveniently moves the adjustment pin 104 to the appropriate channel member 76 of the seat track 70 to maintain the body 102 of the collapsible seat in the substantially horizontal position. The user also conveniently moves the engagement pins 115 along the slot 120 to the opposite channel 122 and moves the connection pins 112 along the slot 119 to the appropriate channel 121 to maintain the arms 108, 110 in the substantially horizontal position. Still further, in FIG. 5C, the surface angles at approximately 60 degrees. The user conveniently moves the adjustment pin 104 to the appropriate channel member 76 of the seat track 70 to maintain the body 102 of the collapsible seat in the substantially horizontal position. The user also conveniently moves the engagement pins 115 along the slot 120 to the opposite channel 122 and moves the connection pins 112 along the slot 119 to the appropriate channel 121 to maintain the arms 108, 110 in the substantially horizontal position.

As such, the user can engage the first arm 108 and the second arm 110 into with at least one of the plurality of arm adjustment positions 118, 117 of the arm track 114, 116 to maintain the first arm 108 and second arm 110 in the substantially horizontal position with respect to any of the angled surfaces 16. To engage the appropriate arm adjustment position 117, the user pulls or "pops" the arms 108, 110 away from the connection pins 112, moves the connection pins 112 within the slots 119 and pushes the arms 108, 110 back toward the connection pins 112 to connect the connection, pins 112 into the appropriate channels 121. Furthermore, the user may stabilize the chair A to the angled surface 16 by penetrating the anchors into the surface. In this expanded position 12, the seat adjustment pin 104 is positioned in its desired channel member 76 of the seat track 70 wherein in this position the seat adjustment pin 104 is positioned behind the front face 46 of the back covering 34. As such, when the person sits in the body 102 of the seat, the person does not directly contact the adjustment pin 104, but instead, contacts the back covering 34. Furthermore, the user adjusts the tension of the collapsible seat by rotating the adjustment pin 104, which, in turn, wraps the crimped end of the seat around the adjustment pin 104.

In view of the above, it will be seen that the several objects of the disclosure are achieved and other advantageous results are obtained. As various changes could be made in the above constructions without departing from the scope of the disclosure, it is intended that all matter contained in the above description or shown in the accompanying drawings shall be interpreted as illustrative and not in a limiting sense.

The invention claimed is:

1. A foldable chair that folds by a plurality of hinges between an expanded position and a collapsed position to seat a person substantially horizontal while the chair is positioned on an angled surface, comprising:

a back assembly having a back frame and a back covering which at least partially covers the back frame, the back frame including opposing back side members, each back side member having a first back end and a second back end;

a seat assembly secured to a seat hinge of the plurality of hinges, the seat hinge pivotally coupling the seat assembly to the back assembly, the seat assembly having a seat frame and a seat adjustment assembly, the seat frame including opposing seat side members, each seat side member having a first seat end and a second seat end, the seat adjustment assembly including a seat track which is integrally disposed within the back side members, the seat track having at least one seat adjustment positions;

a leg assembly secured to a leg hinge of the plurality of hinges, the leg hinge pivotally coupling the leg assembly to the seat assembly, the leg assembly having a leg frame which includes opposing leg side members, each leg side member having a first leg end and a second leg end; and a collapsible seat which is removably coupled to the seat assembly, the collapsible seat having a proximal end, a distal end, a body positioned between the proximal end and the distal end, an adjustment pin and a seat attachment, the proximal end connecting with the adjustment pin, the distal end connecting with the seat attachment wherein the adjustment pin removably engages with at least one of the plurality of seat adjustment positions of the seat track and the seat attachment connects with the seat frame such that the engaged adjustment pin with the seat track and the attached distal end with the seat frame positions the body of the seat in a substantially horizontal position with respect to the angled surface.

2. The foldable chair of claim 1 further comprising an arm assembly having a first arm, a second arm and arm connection pins in contact with the seat side members and a first arm track integrally formed within the back side members.

3. The foldable chair of claim 2 further comprising a second arm track positioned within the first arm and the second arm.

4. The foldable chair of claim 3 wherein the first arm and the second arm removably engage with the first arm track at one end and removably engage at the other end with the second arm track such that the engagement of the first arm and the second arm with the first arm track and the second arm track positions the first arm and the second arm in a substantially horizontal position with respect to the angled surface and locks the seat frame and the back frame in place.

5. The foldable chair of claim 1 further comprising a foot assembly secured to a foot hinge of the plurality of hinges, the foot hinge pivotally coupling the foot assembly to the leg assembly, the foot assembly having a foot frame which includes opposing foot side members, each foot side member having a first foot end and a second foot end.

6. The foldable chair of claim 5 further comprising at least one anchor which removably attaches to at least one of the second back ends, the second seat ends, the second leg ends and the second foot ends.

7. The foldable chair of claim 6 wherein the at least one anchor penetrates the angled surface.

8. The foldable chair of claim 1 wherein each of the second back ends, second seat ends, second leg ends and second foot ends contacts the angled surface.

9. The foldable chair of claim 1 wherein the seat assembly is rotatable around the seat hinge at a plurality of angles with respect to the angled surface.

10. The foldable chair of claim 1 wherein the leg assembly is rotatable around the leg hinge at a plurality of angles with respect to the angled surface.

11. The foldable chair of claim 1 wherein the back assembly is rotatable around the seat hinge at a plurality of angles with respect to the angled surface.

12. The foldable chair of claim 5 wherein the leg assembly is rotatable around the foot hinge at a plurality of angles with respect to the angled surface.

13. The foldable chair of claim 1 wherein the seat track is integrally disposed within the back side members in a position behind the back covering.

14. The foldable chair of claim 1 wherein the adjustment pin is rotatable within the respective seat adjustment position such that the rotation of the adjustment pin adjusts tension of the body.

15. A chair that unfolds by a plurality of hinges between an expanded position to a collapsed position to seat a person substantially horizontal in the expanded position while the chair is positioned on an angled surface, comprising:

a back assembly having a back frame and a back covering which partially covers the back frame, the back frame including opposing back side members which are coupled together by a back cross member;

a seat assembly secured to a seat hinge of the plurality of hinges, the seat hinge pivotally coupling the seat assembly to the back assembly for relative movement of the back assembly and the seat assembly between the collapsed position and the expanded position, the seat assembly having a seat frame and a seat adjustment assembly, the seat frame including opposing seat side members, the seat adjustment assembly includes a seat track which is integrally disposed within the back side members;

a leg assembly secured to a leg hinge of the plurality of hinges, the leg hinge pivotally coupling the leg assembly to the seat assembly for relative movement of the leg assembly and the seat assembly between the collapsed position and the expanded position, the leg assembly having a leg frame which includes opposing leg side members; and a collapsible seat which is removably coupled to the seat assembly, the seat having a proximal end, a distal end, a body positioned between the proximal end and the distal end, the proximal end connecting with the adjustment pin, the distal end connecting with the seat attachment such that the adjustment pin removably engages with the seat track and the seat attachment connects with the seat frame to position the body of the seat in a substantially horizontal position with respect to the angled surface, whereby, in the collapsed position, the leg assembly rotates around the leg hinge to be folded within the seat assembly and the seat assembly rotates around the seat hinge to be folded within the back assembly.

16. The chair of claim 15 further comprising a foot assembly secured to a foot hinge of the plurality of hinges, the foot hinge pivotally coupling the foot assembly to the leg assembly.

17. The chair of claim 16 whereby in the collapsed position the foot assembly rotates around the foot hinge to be in parallel contact with leg assembly.

18. The chair of claim 15 further comprising at least one anchor which removably attaches to at least one of the back side members, the seat side members and the leg side members wherein the at least one anchor penetrates the angled surface.

19. The chair of claim 15 wherein the seat track is integrally disposed within the back side members.

20. A chair that folds by a plurality of hinges between an expanded position and a collapsed position to seat a person substantially horizontal while the chair is positioned on an angled surface, comprising:

a back assembly having a back frame and a back covering which partially covers the back frame, the back frame including opposing back side members, each back side member having a first back end and a second back end;

a seat assembly secured to a seat hinge of the plurality of hinges, the seat hinge pivotally coupling the seat assembly to the back assembly, the seat assembly having a seat adjustment assembly, the seat adjustment assembly includes a seat track which is integrally disposed within the back side members, the seat track having a plurality of seat adjustment positions; and a collapsible seat which is removably coupled to the seat assembly, the collapsible seat having a proximal end, a distal end, a body positioned between the proximal end and the distal end, an adjustment pin and a seat attachment wherein the proximal end connecting with the adjustment pin, the distal end connecting with the seat attachment wherein the adjustment pin removably engages with at least one of the plurality of seat adjustment positions of the seat track such that the engaged adjustment pin with the seat track positions the body of the seat in a horizontal position with respect to the angled surface and such that the adjustable pin is rotatable within the respective seat adjustment position such that the rotation of the adjustment pin adjusts tension of the body of seat.

* * * * *